US010072361B2

(12) United States Patent
Thomson et al.

(10) Patent No.: US 10,072,361 B2
(45) Date of Patent: Sep. 11, 2018

(54) FABRIC SYSTEM

(71) Applicants: GRT DEVELOPMENTS PTY LIMITED, Mosman NSW (AU); RMIT UNIVERSITY, Melbourne VIC (AU)

(72) Inventors: Matthew Thomson, Mosman (AU); Scott Thomson, Dulwich Hill (AU); Pushpaji Shyamal Rathugaman, Officer (AU)

(73) Assignees: GRT DEVELOPMENTS PTY LIMITED, Mosman NSW (AU); RMIT UNIVERSITY, Melbourne VIC (AU)

( * ) Notice: Subject to any disclaimer, the term of this patent is extended or adjusted under 35 U.S.C. 154(b) by 460 days.

(21) Appl. No.: 14/772,179

(22) PCT Filed: Mar. 7, 2014

(86) PCT No.: PCT/AU2014/000220
§ 371 (c)(1),
(2) Date: Sep. 2, 2015

(87) PCT Pub. No.: WO2014/134682
PCT Pub. Date: Sep. 12, 2014

(65) Prior Publication Data

US 2016/0017521 A1 Jan. 21, 2016

(30) Foreign Application Priority Data

Mar. 7, 2013 (AU) ..... 2013900785

(51) Int. Cl.
*D02G 3/02* (2006.01)
*D02G 3/04* (2006.01)
(Continued)

(52) U.S. Cl.
CPC ..... *D02G 3/045* (2013.01); *D01F 8/06* (2013.01); *D02G 3/26* (2013.01); *D02G 3/32* (2013.01); *D02G 3/328* (2013.01); *D02G 3/38* (2013.01); *D02G 3/442* (2013.01); *D03D 1/0041* (2013.01); *D03D 15/08* (2013.01); *D04B 1/16* (2013.01); *D04B 1/18* (2013.01); *D04B 1/24* (2013.01);
(Continued)

(58) Field of Classification Search
CPC .. D02G 3/38; D02G 3/286; D07B 2201/2023; D07B 2201/2055; D07B 2201/2057
See application file for complete search history.

(56) References Cited

U.S. PATENT DOCUMENTS 5,210,877 A 5/1993 Newman
6,279,305 B1 * 8/2001 Hummel ..... A41D 19/01511 57/210
(Continued)

OTHER PUBLICATIONS

International Search Report for PCT/AU2014/000220 dated May 16, 2014.
Written Opinion for PCT/AU2014/000220 dated May 16, 2014.

*Primary Examiner* — Tejash Patel
(74) *Attorney, Agent, or Firm* — Sughrue Mion, PLLC

(57) ABSTRACT

A composite yarn comprising one or more ultra-high molecular weight polyethylene fibers wrapped around one or more polyurethane-polyurea copolymer fibers.

20 Claims, 9 Drawing Sheets
(3 of 9 Drawing Sheet(s) Filed in Color)

(51) Int. Cl.

| | |
|---|---|
| ***D03D 15/08*** | (2006.01) |
| ***D03D 1/00*** | (2006.01) |
| ***D04B 1/16*** | (2006.01) |
| ***D02G 3/32*** | (2006.01) |
| ***D01F 8/06*** | (2006.01) |
| ***D02G 3/26*** | (2006.01) |
| ***D02G 3/38*** | (2006.01) |
| ***D04B 1/24*** | (2006.01) |
| ***D02G 3/44*** | (2006.01) |
| ***D04B 1/18*** | (2006.01) |

(52) U.S. Cl.
CPC ..... *D10B 2321/0211* (2013.01); *D10B 2403/0114* (2013.01); *D10B 2501/04* (2013.01)

(56) References Cited

U.S. PATENT DOCUMENTS

| | | | | |
|---|---|---|---|---|
| 6,581,366 | B1 | 6/2003 | Andrews | |
| 2003/0037530 | A1 | 2/2003 | Zhu | |
| 2004/0187471 | A1 * | 9/2004 | Andrews | D02G 3/38 57/232 |
| 2012/0060563 | A1 | 3/2012 | Henssen | |
| 2014/0090349 | A1 * | 4/2014 | Fisher | D02G 3/367 57/222 |

* cited by examiner

FABRIC SYSTEM

CROSS REFERENCE TO RELATED APPLICATIONS

This application is a National Stage of International Application No. PCT/AU2014/000220 filed Mar. 7, 2014, claiming priority based on Australian Provisional Application No. 2013900785 filed Mar. 7, 2013, the contents of all of which are incorporated herein by reference in their entirety.

FIELD OF INVENTION

The present invention relates to a novel fabric system for use in protecting a wearer from injury, such as injuries inflicted by friction or chaffing.

In one form, the invention relates to a fabric system comprising a specific combination of synthetic yarns that provide increased protection from friction injury during sporting activities and other movement related activities.

In one particular aspect the present invention is suitable for use in garments worn during sporting activities.

While it is convenient to hereinafter describe the invention in relation to protecting cyclists from friction related injury if they fall from their bicycle, it will be appreciated that the invention is not so limited and can be used to reduce various types of injury in a wide variety of sports. In particular, the invention has applicability to accidents that involve a person sliding along a surface, such as gravel, asphalt, sinter, dirt or grass. This could, for example include sporting accidents occurring during track and field sports such as running, high jumping or pole vaulting; field sports such as hockey, soccer, or football; roller sports such as skateboarding, roller skating or scooter riding; court sports such as tennis, badminton or squash; or simply walking. The invention also has applicability to non-sport related injury such as those that may be incurred during military training or fire fighting or other physical occupations.

BACKGROUND ART

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

Sporting clothing typically fits closely to the wearer's body to reduce wind resistance, to avoid catching or dragging on equipment (e.g. bicycle seat) or to make the wearer harder to tackle in the case of contact sports. Sporting clothing is also typically manufactured of fabric that is lightweight, breathable and does not hinder freedom of movement or restrict the wearer in any way. Some sporting clothing is designed to be particularly close fitting to provide compression and aid muscle recovery. It is also typically brightly coloured for fashion reasons and/or team identification.

Popular fabrics for manufacture of sporting clothing include Lycra®, Spandex®, often in combination with nylon or polyester. However, these fabrics tend to rip or tear when subjected to frictional forces. This leaves the wearer vulnerable to grazing if they lose balance at speed and slide along a track or playing surface. Furthermore, the repeated movement of popular fabrics back and forward across the wearer's skin (e.g., against the groin, nipples, arm pits or feet) can cause friction related blistering, chaffing and irritation of sensitive skin, particularly if the skin has been made damp and soft by perspiration. This is particularly problematic for long-distance runners and cyclists.

Grazing injury is a destructive process caused by separation of layers of skin due to mechanical forces. The skin structure can be traumatized by force applied perpendicularly to the skin and by shear force in the same plane as the skin. A sports participant such as a cyclist or horse rider falling at slow or fast speed is at high risk of suffering grazing injuries to their thighs, back upper buttocks, arms shoulders and upper back. Even runners falling at much lower speed are likely to suffer grazing to their knees, lower back, legs and thighs when they contact the track or roadway. Similarly, children may suffer grazing when the fall, trip or stumble while running or during other play activities. Furthermore, due to normal aging processes the elderly often have very fragile skin and can suffer grazing injuries when their skin rubs against the inner surface of shoes, other body parts, mobility aids or bed clothes.

Protective Fabrics

There are many different types of fabrics designed to protect the human body from a range of external forces, particularly direct physical or mechanical forces. For example, as described in U.S. Pat. No. 5,008,959, lightweight body armour is made of woven or non-woven fabric composed of filaments of very high molecular weight polymers. Bullets impacting on body armour generally do not have sufficient energy and force to break a significant number of the filaments which make up the armour fabric. The impact can elongate, distort and deform the fabric, but doing so they expends and dissipates energy so that there is insufficient energy to penetrate the fabric. Aramid polymer filaments and yarns, sold under the trademark Kevlar®, and a polyethylene material, commercially referred to as Spectra® have been extensively used in these types of fabrics. (Kevlar® is a trade mark of DuPont Corporation; Spectra® is a trade mark of Honeywell.)

In the past, high performance technical fibre yarns such as those described in U.S. Pat. No. 5,008,959 were limited to special applications such as protective body armours and composites in engineering applications. However, more recently their use has been expanded to general textile applications.

However, physical force associated with the penetrating energy of a bullet is significantly different to abrasive frictional force and a different type of protective fabric is required. U.S. Pat. No. 5,918,319 describes protective garments, such as pants and jackets, incorporating an abrasion-resistant fabric which is suitable for motorcyclists. The fabric of the invention incorporates a high performance fibre, such as Kevlar®, terried on a face side of the fabric and residing adjacent to the shell fabric of the garment. The aramid fibres are thermally stable up to 800 to 900° F., as compared to cotton which starts to decompose at 300 to 400° F. Additionally, these fibres do not melt like nylon or polyester fibres. Thus, while the heat and friction generated when sliding on pavement or other abrasive surface quickly tears away the cotton fabric of the garment, the high performance aramid fibres maintain their structure and effectively disperse the heat as the individual terried fibres ride up, around, and over the abrasive surface. However, the fabrics suitable for motorcyclists are not suitable for athletes because the fabrics are too heavy, inflexible and do not breath sufficiently.

U.S. Pat. No. 5,210,877 describes outwear garments for cyclists that substantially protect the wearer from cuts and grazing in the event of a fall or a crash. The outwear comprises protective fabric panels containing abrasion and cut resistant high performance yarn of ultra high molecular weight polyethylene fibre of approximately 215 denier, such as Spectra® in combination with Lycra® or other yarns.

With all of these past improvements in protective fabrics there is still a need for new protective fabrics that do not detract from the wearer's comfort or freedom to move during sporting activities.

SUMMARY OF INVENTION

An object of the present invention is to provide an improved fabric system that is suitable for use in garments.

Another object of the present invention is to provide garments comprising the fabric system that reduce injuries in the event of an accident.

A further object of the present invention is to provide a fabric system that can be fashioned into garments that protect a wearer from frictional forces, particularly in the event of a fall or other accident.

A further object of the present invention is to alleviate at least one disadvantage associated with the related art.

It is an object of the embodiments described herein to overcome or alleviate at least one of the above noted drawbacks of related art systems or to at least provide a useful alternative to related art systems.

The present invention provides a protective fabric system and apparel utilizing a novel fabric system to decrease abrasion. Embodiments of the present invention include combination of friction resistant fabrics with other types of fabrics. Embodiments include such fabric systems adapted to reduce friction for example, in shorts, or a bib-short athletic garment useful for cyclists. Other embodiments include methods of producing such multi-layer protective fabric systems and apparel.

In a first aspect of embodiments described herein there is provided a composite yarn comprising one or more ultra-high molecular weight polyethylene (UHMWPE) fibres wrapped around one or more polyurethane-polyurea copolymer fibres.

Where used herein the term 'yarn' is intended to refer to one or more continuous, often plied fibres of natural or man-made material suitable for use in weaving and knitting to form fabric.

In a second aspect of embodiments described herein there is provided a fabric system comprising ultra-high molecular weight polyethylene (UHMWPE) yarn, polyurethane-polyurea copolymer yarn and a further natural or synthetic yarn.

Preferably the further yarn is a polyamide, such as the polyamide commonly referred to as Nylon. For example, the polyamide may be chosen from nylon 6, nylon 6:6, nylon 5:10 or nylon 6:12.

Typically the further yarn is 10 to 150 denier, preferably from 30 to 100 denier, more preferably between 30 and 75 denier.

Preferably the fabric system has a first yarn comprising Nylon and a second yarn comprising a composite of UHMWPE and polyurethane-polyurea copolymer.

Typically the polyurethane-polyurea copolymer yarn is between 20 and 40 denier. The polyurethane-polyurea copolymer yarn is also referred to in the art as elastane or Spandex®, and is sold under various trade marks including, Lycra™, Elaspan™, Acepora™, Creora™, ROICA™, Dorlastan™, Linel™ and ESPA™. In a particularly preferred embodiment the polyurethane-polyurea copolymer yarn is Creora™ H-350 spandex yarn.

Spandex® fibers suitable for use in the present invention may be produced by any process known in the art such as melt extrusion, reaction spinning, solution dry spinning, and solution wet spinning. Solution dry spinning is used to produce over 94.5% of Spandex fibers. Manufacturing includes an initial step of reacting monomers produce a prepolymer that is subjected to further reactions and drawn out to make fibers. Variations in type and amount of low and high power Spandex® may be used to achieved different desired results or characteristics.

Typically the UHMWPE yarn is between 10 and 250 denier, more preferably 75 and 125 denier, even more preferably between about 50 and 100 denier. Preferably the UHMWPE yarn is a flat multi filament yarn.

The yarn combination can be varied to achieve certain characteristics such as the desired fabric weight.

In another aspect of embodiments described herein there is provided a method of manufacturing the composite yarn of the present invention comprising the step of wrapping a UHMWPE yarn around a polyurethane-polyurea copolymer yarn.

There are three main ways of wrapping one yarn around another, that is (i) by air intermingling, (ii) single covering and (iii) double covering. It is also possible to make any desirable combination of (i), (ii) and/or (iii). Air intermingling is a wrapping process where the filaments of wrapping yarn intermingle with the core yarn and textured filament is used for the air intermingling process. Single wrapping is a process where a single yarn is wrapped around the core yarn. For double wrapping, two yarns are wrapped in opposite directions around a core yarn. Usually spun yarns, single filament yarns or flat multifilament yarns are used in single and double covering methods.

Preferably the UHMWPE yarn is wound at a rate of 200 to 800 turns per meter. The actual winding rate can vary depending on the desired characteristics of the composite yarn and resultant material. Typically, some of the yarns are S twisted and others Z twisted. A combination or multi-weave may also be used. In some instances a combination of S and Z twist, or solely S or Z, or intermingling before S and Z twisting can provide desired results.

In a yet further aspect of embodiments described herein there is provided a method of manufacturing fabric system having a first yarn of nylon and a second yarn comprising a composite of UHMWPE and polyurethane-polyurea copolymer, the method comprising the step of knitting the first yarn with the second yarn to create a structure chosen from the group comprising single jersey plain knit, weft-locknit, cross-miss and birds-eye knit, or derivatives of these structures such as variations on birds-eye knit.

In a particularly preferred embodiment the fibres are woven in a four layered birdseye structure or any of the structures referred to below as T1 to T5, or derivates of these, preferably with tuck knits.

The preferred embodiment of the method of manufacturing can be varied to suit to the type of machine being used.

For example, if a warp or weft knitting production machine is used then variants of the abovementioned structures can be used to achieve yarn having a desired characteristic. If a seamless knitting machine is used, then the combination may be dictated at least in part by the machine specifications. Furthermore, each machine has a specific purpose. For example, a Santoni™ seamless machine is typically used to produce seamless circular knitted fabrics suitable for the legs of trousers and shorts or sleeves. A 'weft or warp' machine is typically used to produce knitted fabric which is then cut to provide pieces according to various designs before being stitched together in a technique known as 'cut and sow'. The machines known as 'weft and wrap' tend to operate on a much high scale of production.

Garments

In another aspect of embodiments described herein there is provided a garment comprising the composite yarn of the present invention comprising one or more UHMWPE fibres wrapped around one or more polyurethane-polyurea copolymer fibres.

In another aspect of embodiments described herein there is provided a garment comprising the fabric system of the present invention.

The fabric system of the present invention is suitable for use in various garments including sporting garments and garments for other motion related activities, children's clothing and clothing for the elderly who may need protection from friction and chaffing.

When compared with fabric systems of the prior art, the fabric system of the present invention is up to 30 times stronger and provides superior wearer protection against damage from friction, cuts, scrapes, grazes resulting from motion related activity. The fabric system of the present invention is also breathable, has sufficient elasticity to provide a comfortable fit and exhibits 'wicking' qualities the cool the wearer's body.

The fabric system must be sufficiently flexible, pliable and resilient to readily conform to the contours of the wearer's body, or a portion of their body, that is intended to be protected by the fabric system. It is particularly important that the fabric is sufficiently flexible, pliable and resilient to be made into a garment which can substantially envelop the upper torso or lower torso or limbs of a wearer. The fabric system of the present invention is also softer and smoother than many fabrics of the prior art.

Preferably the fabric system of the present system is incorporated into a garment in a position where it can protect the parts of a wearer that are sensitive or most at risk from damage. For example, it may be used in the sleeves and in one or more back panels of a cyclist's jersey to provide protection to the rider's arms, elbows, and back if they fall from their bicycle at speed onto a hard or rough surface. Typically, as the cyclist hits and slides along the surface, the fabric system will disperse heat and reduce the likelihood of burning. Furthermore the fabric system of the present invention is up to 30 times stronger than similar systems of the prior art and protects the cyclist from cuts, grazes and small stones being embedded in the skin.

In yet a further aspect of embodiments described herein there is provided a garment comprising two or more, preferably multiple panels, wherein at least one panel comprising the fabric system of the present invention.

The fabric system of the present invention can be used for construction of an entire garment, or just parts, such as individual panels. The fabric system of the present invention can be manufactured to provide any desired fabric weight (typically measured in $g \cdot m^{-2}$ and referred to as GSM levels). Hence, the fabric system of the present invention can have a GSM level tailored to provide consistency when it is integrated with other fabrics in a garment.

For example, conventional cycling shorts (knicks) generally have a four, six, or eight panel construction, elastic ribbing around the bottom of the leg cuffs and the waist, and additional padding (termed a 'chamois') in the region of the buttocks and crotch. Preferably the shorts include two panels, each respectively extending from the waist to a leg cuff that are made of the fabric system of the present invention in order to protect the wearer's hip and buttocks from grazing.

Other aspects and preferred forms are disclosed in the specification and/or defined in the appended claims, forming a part of the description of the invention.

In essence, embodiments of the present invention stem from the realization that specific high performance fibres can be combined with existing fibres commonly used in sports clothing to provide improved protection against injuries caused by friction, particularly grazing.

When used as a garment, the fabric system of the present invention provides advantages including:

- reducing damage to human tissue when a wearer comes into contact with a hard or tough surface;
- providing improved dispersion of heat when a wearer contacts a surface at speed;
- providing high resistance to tearing or ripping when a wearer contacts a surface;
- improving protection against injury without significant adverse effect on the aerodynamics or weight of the garment;
- maintaining the positive qualities of sporting clothing including breathability and not restricting movement;
- having a wide range of applications, from elite athletes to children in playgrounds; and
- reducing injury generally, with concomitant reduction in time away from the sport/training and medical costs.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

The patent or application file contains at least one drawing executed in color. Copies of this patent or patent application publication with color drawings will be provided by the Office upon request and payment of the necessary fee.

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which.

DETAILED DESCRIPTION

Yarns & Fabric

Figure 1:
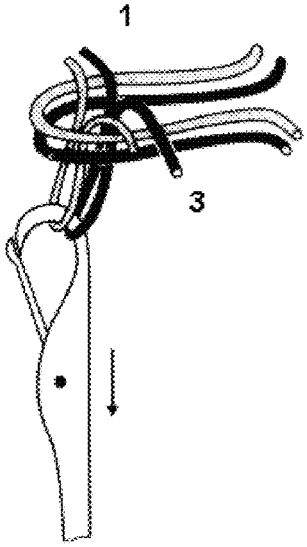
FIG. 1 is a schematic diagram illustrating the operation of a knitting machine when fed two yarns simultaneously for plating and indicating the technical back (1) and technical face (3)
Figure 2A:
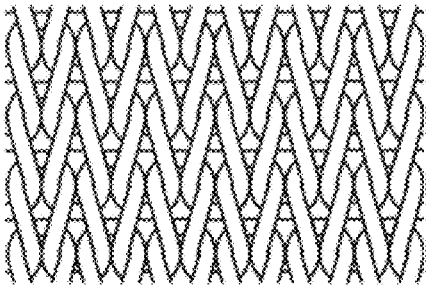
FIGS. 2(*a*), 2(*b*), 2(*c*) and 2(*d*) illustrate fabric structures in detail as structural notations for 2(*a*) plain, 2(*b*) weft locknit, 2(*c*) cross miss and 2(*d*) birds eye.
Figure 2B:
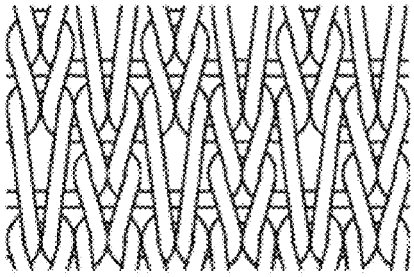
Figure 2C:
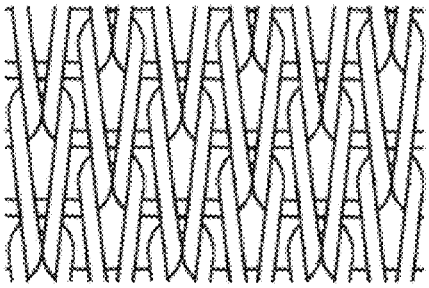
Figure 2D:
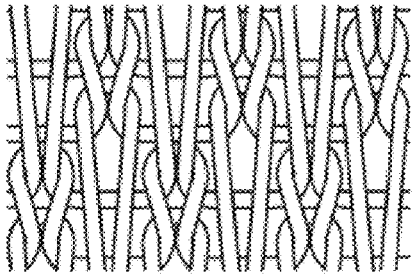
Figure 3A:
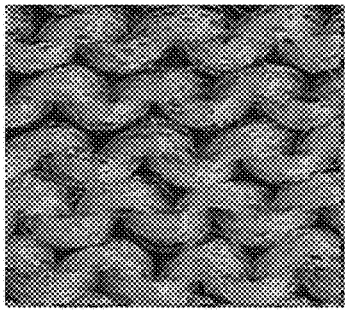
FIGS. 3(*a*), 3(*b*), 3(*c*) and 3(*d*) illustrate the technical back of polyester/nylon fabric having 3(*a*) plain, 3(*b*) weft locknit, 3(*c*) cross miss and 3(*d*) birds eye fabric structures.
Figure 3B:
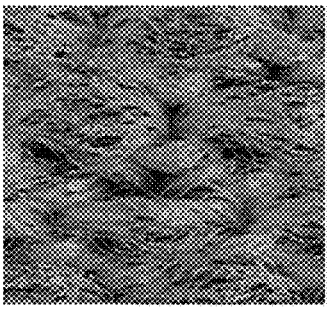
Figure 3C:
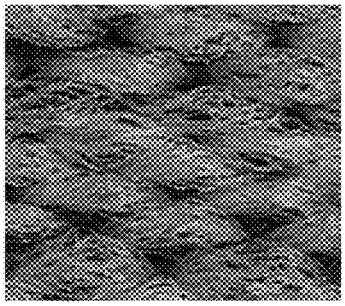
Figure 3D:
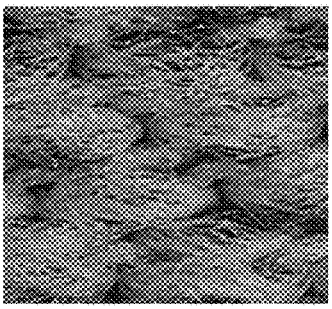
Figure 4A:
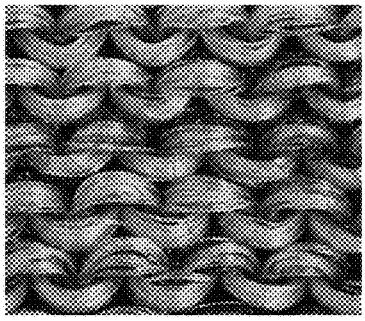
FIGS. 4(*a*), 4(*b*), 4(*c*) and 4(*d*) illustrate the technical back of UHMWPE/nylon fabrics having 4(*a*) plain, 4(*b*) weft locknit, 4(*c*) cross miss and 4(*d*) birds eye fabric structures.
Figure 4B:
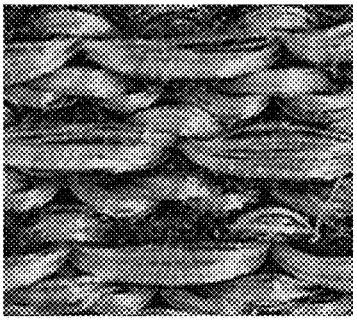
Figure 4C:
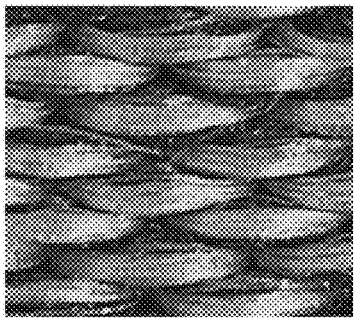
Figure 4D:
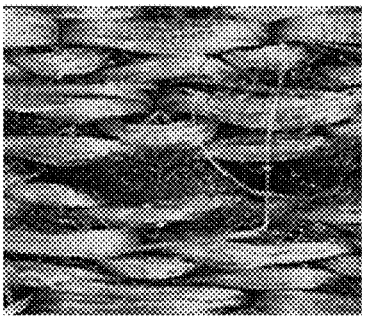
Figure 5A:
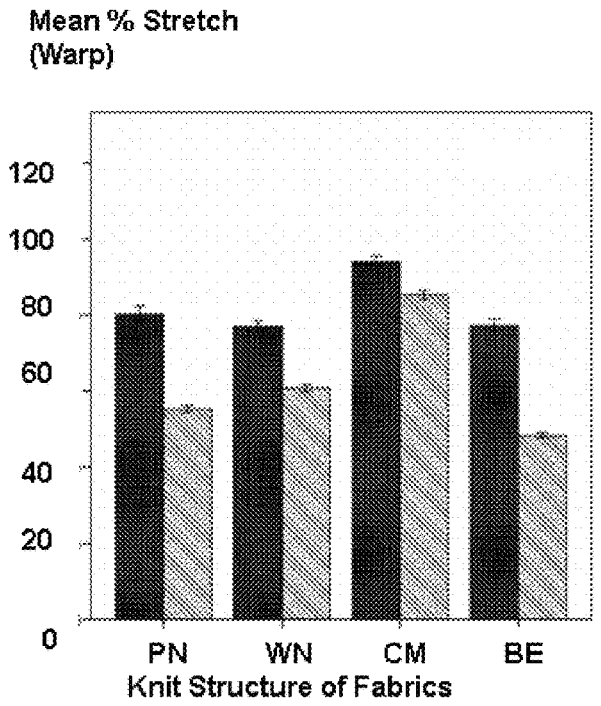
FIGS. 5(*a*), 5(*b*), 5(*c*) and 5(*d*) illustrate a number of plots depicting the results of mean stretch and residual extension tests for polyester/nylon (dark shading) and UHMWPE/nylon (light shading) where the y-axis refers to percentage; 5(*a*) stretch in warp direction, 5(*b*) stretch in weft direction, 5(*c*) residual extension in warp direction, and 5(*d*) residual extension in the weft direction.
Figure 5B:
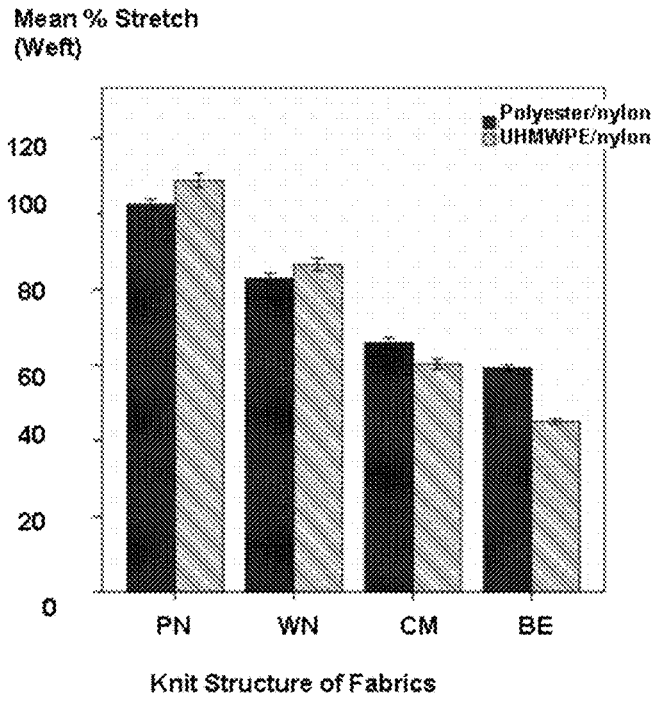
Figure 5C:
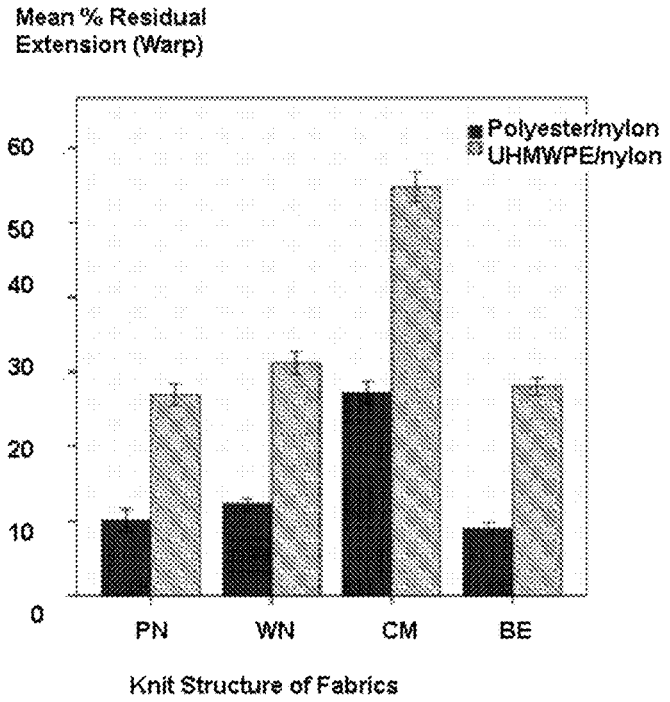
Figure 5D:
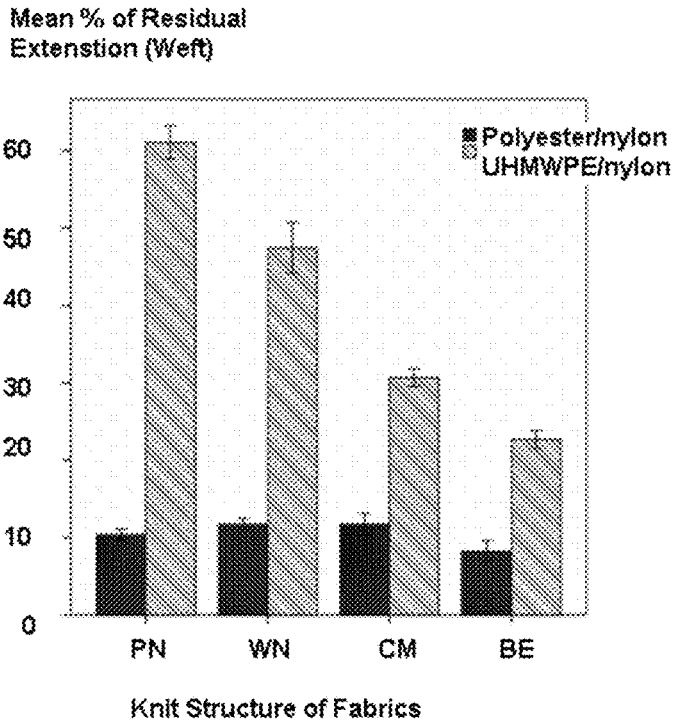

The yarns and fabric system of the present invention is suitable for use in producing fabric, or garments comprising the fabric, or panels for insertion into garments.

A fabric according to the present invention has been made from composite yarn and an air textured continuous filament nylon yarn of 75 denier linear density. This particular yarn is selected for three main reasons:

1. when the fabrics relaxing after knitting the textured yarn has the ability to add bulkiness to the fabric and for this reason, when it is dyed it provides better colour coverage;
2. a higher level of cover can be achieved with lower fabric weight using textured yarns compared to non-textured yarns; and
3. a lower GSM fabric can be achieved. As part of the finishing process the fabric can under go several treatments such as 'stretch and set' that have the effect of reducing the fabric weight per GSM.

The composite yarn preferably comprises one or more different combinations of 10 to 100 denier UHMWPE flat continuous filament yarn wrapped around an elongated 20 to 40 denier Spandex low or high power filament yarn. The 40 denier Spandex® yarn tends to provide a higher level of stretch to the fabric system than is usually required for sporting garments, and typically 20 denier Spandex® will be more appropriate. The Spandex® yarn tends to improve fabric recovery properties, countering the comparatively poor recovery property of fabric made of UHMWPE (which is due to its low surface friction). The yarn twist rate for the covered yarn will vary depending on the desired resultant characteristic and whether it is SC, DC or TC (which is the combination referred to above). The covering process it typically either S, Z, intermingling or combination.

In order to achieve different level of finished fabric weights to suit different requirements, the composite yarn may be varied in weight from 10 Denier up to 100 Denier or more. The level of Spandex® and the TPM may also vary. A lower denier UHWMPE can be used with a high tension or low tension Spandex®. As a function of fabric weight, a low tension Spandex® will produce a lower GSM fabric with a low TPM. Hence if a very thin fabric, with high abrasion resistance qualities was required, typically one would pick a low denier UHWMPE and a low tension spandex, low TPM, with either single covering or double covering. If hand feel was very important, then a DC option together with the finishing process of 'stretch and setting' would be required. The UHWMPE is low level may require intermingling then double covering which may be termed triple covering.

The requirement for hand feel is at least partly dependent on the weight of the garment. The heavier the garment, the harder the hand feel. The softer the garment the better the hand feel but the worse lower the abrasion resistance.

Samples of the fabric system were made using a Santoni SM8-EVO4 circular knitting machine, which is a 26 gauge single jersey machine with 16 inch diameter cylinder and 8 feeders. During fabric manufacture the step motor position was kept constant to ensure constant stitch height at production for all fabrics. Yarn input tension and take down air pressure were also kept constant. Four fabric structures were selected—plain single jersey, weft-licknit, cross-miss and birds-eye.

The fabrics were double faced, with the nylon yarn becoming the technical face while the composite yarn was the technical back. The knitting machine was a single jersey weft knitting machine, hence a plating technique was used for fabric development. Plating is a knit construction, in which two or more yarns are fed simultaneously. The second yarn is generally of a different colour or type. During the knitting process the second yarn is placed under the first yarn, so that each yarn can be rolled to a specific side of the fabric. In many cases, one yarn/colour appears on the face of the fabric, and the other yarn/contrast colour appears on the back. (It is also possible to obtain double faced fabrics using double jersey weft knitting, warp knitting, and weaving methods.)

There are several advantages associated with having double faced fabrics, including:

- Nylon in technical face can be dyed in various colours and is not limited to a narrow range of solution dyed colours. However, it is highly recommended to control the temperature of the long wet processes such as scouring and dyeing at 60° C. Alternatively, it is possible to replace nylon with any other natural and/or manmade fibre which can be dyed at temperatures at or below at 60° C.;
- the use of DC allows UHWMPE to be covered with nylon (super micro fibre) and hidden with the covering yarn taking the dye in addition to improving hand feel. Hand feel can be further improved by other commercial means such as stretching and setting;
- the finishing process (heat setting) can take place at 140° C. for no more than two minutes;
- UHMWPE is comparatively inert to chemicals, and has comparatively low moisture absorption;
- a fabric comprising UHMWPE yarn as an inner layer adjacent a wearer's skin and a yarn having better moisture absorption fibre as the outer layer will provide better moisture management properties than a fabric made of UHMWPE yarn alone.

Fabric Knitting

Fabrics according to the present invention may be manufactured using any suitable knitting machine known in the art, including production weft, warp or seamless knitting machines such as the machine mentioned above—characterised as a Santoni SM8-EVO4 circular 26 gauge single jersey machine with 8 feeders and a cylinder of 16 inch diameter. This knitting machine is particularly preferred for development because it allows the user to select needle-to-needle operations electronically, has a reduced number of feeders and it provides electronically-controlled stitch regulation by means of an independent step motor on each feeder and it facilitates multiple-yarn feeding up to eight yarns with variations in the colour and patterning.

Preferably, during operation the stepping-motor position is set constant ensuring the constant stitch height is maintained during production for all samples. Yarn-input tensions and the take-down air pressure are also kept constant. Two yarns may be fed simultaneously in the manner illustrated in FIG. 1. This method of feeding two or more yarns simultaneously is called plating. The basic rule of plating is that the yarn fed nearest to the needle head shows on the reverse side of the needle loop and therefore shows on the surface of the technical back. The second yarn is in a lower position and tends to show on the technical face (Spencer, D. J., *Knitting Technology: A comprehensive handbook and practical guide.* 3rd ed. 2001, Cambridge, England: Woodhead Publishing Limited.)

Fabric according to the present invention and knitted as described above has been investigated and the physical properties have been investigated (including physical properties such as weight, stretch and recovery, optical porosity, comfort, cooling, surface roughness and surface friction in the wet relaxed state).

Several combinations of fabrics were manufactured in two groups. In one example a 140 denier air-textured filament Nylon 6.6 yarn was used as the ground yarn for both groups. For the plate yarn, a 100 denier air-textured filament polyester yarn was used in the first group of fabrics and a 100 denier flat-filament UHMWPE yarn was used for the second group of fabrics. Four fabric structures were selected, namely (i) single jersey plain, (ii) weft-locknit, (iii) cross-miss and (iv) birds-eye.

Fabric weight, courses and wales per centimeter, thickness and optical porosity values for both yarn combinations are presented in Table 1. Even though the fabrics were manufactured under constant knitting conditions, fabric weight results show that there is a difference with regards to the knit structure as well as the yarn combination. As illustrated in the theoretical structures of FIGS. 2(*a*), 2(*b*), 2(*c*) and 2(*d*), structures that comprise miss stitches should have much longer 'V' shapes on the technical face and consequently, higher porosity than the plain structure. In fact in practice it does not happen that way. In order to carry the held loop over miss stitches and wait until the next knit stitch comes up, stitches should rob yarns from consecutive stitches. After the wet process, the fabrics which have reached their wet relaxed status exhibited different properties between each structure.

There is not much difference between a polyester/nylon fabric (fabrics used in garments today) and its structurally equivalent UHMWPE/nylon fabric.

TABLE 1

Physical properties of finished fabrics

| Yarn combination | Knit Structure | Weight ($g/m^2$) | Courses (per cm) | Wales (per cm) | Thickness (mm) | Optical porosity (%) |
|---|---|---|---|---|---|---|
| Polyester/ Nylon | PN—Plain | 220 | 18.8 | 12.6 | 0.85 | 7.4 |
| | WN—Weft-locknit | 242 | 24.2 | 13.1 | 1.02 | 5.2 |
| | CM—Cross-miss | 262 | 30.9 | 13.5 | 1.06 | 4.0 |
| | BE—Birds-eye | 263 | 31.3 | 13.5 | 1.06 | 3.7 |
| UHMWPE/ Nylon | PN—Plain | 210 | 16.8 | 12.9 | 0.85 | 7.7 |
| | WN—Weft-locknit | 230 | 23.8 | 12.9 | 0.89 | 5.0 |
| | CM—Cross-miss | 246 | 28.4 | 12.9 | 0.92 | 3.6 |
| | BE—Birds-eye | 268 | 31.9 | 12.8 | 0.93 | 2.6 |

Fabric Stretch and Residual Extension

UHMWPE/nylon fabrics of the present invention appear to have lower extensibility than polyester/nylon fabrics in the warp direction. This was true of all four fabrics, (i.e. 25%, 16%, 9% and 29%) in plain, weft-locknit, cross-miss and birds-eye fabrics respectively. In the weft direction, stretchability of the UHMWPE/nylon combination is slightly higher for plain and weft-locknit fabrics (6% and 4%) but 5% and 14% lower for cross-miss and birds-eye fabrics relative to the polyester/nylon combination. Different loop and float structures in the fabrics greatly affected the stretchability in the weft direction. The higher the successive numbers of miss stitches, the lower the stretch of the fabric. Though the weft-locknit and cross-miss have similar numbers of consecutive misses, cross-miss exhibited lower stretch than weft-locknit due to high and even distribution of miss stitches in the cross-miss fabrics. This same stitch pattern also imparts high stretch characteristics to the cross-miss fabric as compared to the other three fabrics in the warp direction.

Residual extension for the UHMWPE/nylon yarn combination is always higher than the polyester/nylon yarn combination in both directions within every knit structure. In the warp direction, the residual extensions range between 26% and 54% and in the weft direction they lie between 23% and 61% for the UHMWPE/nylon combination. For the polyester/nylon combination, the residual extensions range between 9% and 27% and between 8% and 12% in the warp and weft directions respectively. Higher residual extension values of fabrics made of UHMWPE/nylon make them unfit for apparel fabrics.

Surface Friction and Roughness

TABLE 2

Surface Roughness and Friction Test Results of Finished Fabrics

| Yarn | Test direction | Fabric code | MIU | Std deviation | MMD | Std deviation | SMD | Std deviation |
|---|---|---|---|---|---|---|---|---|
| Polyester/ Nylon | Warp | PN | 0.412 | 0.009 | 0.014 | 0.001 | 5.963 | 0.557 |
| | | WN | 0.351 | 0.016 | 0.031 | 0.003 | 17.380 | 0.356 |
| | | CM | 0.358 | 0.001 | 0.012 | 0.001 | 9.752 | 0.348 |
| | | BE | 0.369 | 0.004 | 0.014 | 0.001 | 11.192 | 0.630 |
| | Weft | PN | 0.239 | 0.006 | 0.005 | 0.003 | 2.837 | 0.367 |
| | | WN | 0.233 | 0.004 | 0.006 | 0.001 | 2.898 | 0.063 |
| | | CM | 0.216 | 0.004 | 0.005 | 0.001 | 3.688 | 0.069 |
| | | BE | 0.237 | 0.006 | 0.005 | 0.001 | 4.113 | 0.138 |
| UHMWPE/ Nylon | Warp | PN | 0.252 | 0.009 | 0.020 | 0.001 | 12.020 | 0.851 |
| | | WN | 0.259 | 0.008 | 0.022 | 0.002 | 14.468 | 0.869 |
| | | CM | 0.218 | 0.018 | 0.014 | 0.002 | 7.152 | 0.353 |
| | | BE | 0.254 | 0.006 | 0.021 | 0.003 | 11.353 | 0.348 |
| | Weft | PN | 0.140 | 0.002 | 0.008 | 0.001 | 7.600 | 0.610 |
| | | WN | 0.117 | 0.066 | 0.007 | 0.001 | 3.258 | 0.237 |
| | | CM | 0.113 | 0.003 | 0.009 | 0.002 | 3.197 | 0.301 |
| | | BE | 0.185 | 0.006 | 0.008 | 0.001 | 3.065 | 0.345 |

Figure 6A:
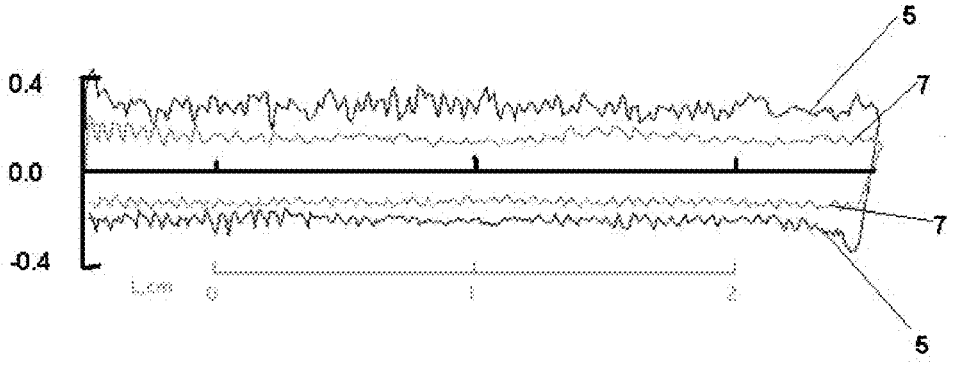
FIGS. 6(*a*) and 6(*b*) include, respectively, graphical representations illustrating the mean value of coefficient of friction (MIU) and mean deviation of surface roughness (SMD) in warp (5) and weft (7) directions for the plain single jersey fabric made of UHMWPE/nylon plated fabric.
Figure 6B:
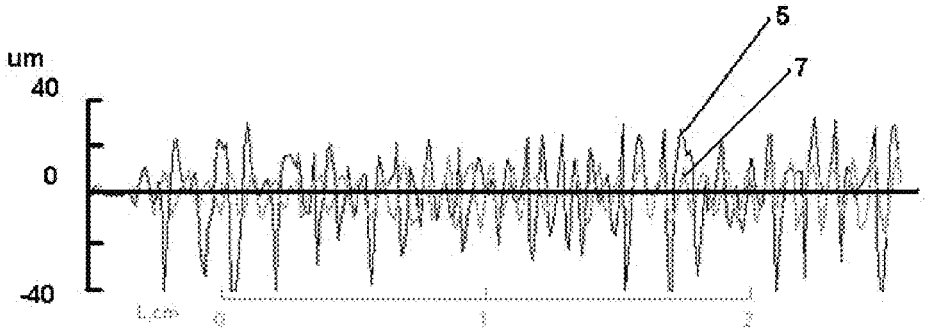

Surface roughness and friction were measured on the technical back of the fabrics, the side which contacts the skin during wear. Columns of interlocking semi-circles formed by the heads of the needle loops and the bases of the sinker loops determine the surface properties of the fabric. In this case, the UHMWPE yarns are preferentially in contact with the measuring probes of the test equipment. FIGS. 6(*a*) and 6(*b*) illustrate the MIU and SMD graphs obtained for UHMWPE/nylon plain fabric in the warp and weft directions. It can be seen that both surface friction and roughness values are always higher in the warp direction than the weft direction, not only in plain fabric but also in every other fabric structure (Table 2).

It is an advantage of the fabric system of the present invention is that when compared to fabric systems of the prior art, it has lower friction and roughness on the wearer's skin, and can thus be used to form more comfortable garments.

FIGS. 3(*a*), 3(*b*), 3(*c*), 3(*d*), 4(*a*), 4(*b*), 4(*c*) and 4(*d*) show the technical back of the fabrics. FIGS. 2(*a*), 2(*b*), 2(*c*) and 2(*d*) clearly illustrate the difference in the appearance of textured polyester yarns and flat filament UHMWPE yarns after wet relaxation of the fabrics. Both Plain fabrics do not differ much in appearance compared with the other knitted fabrics. The mean coefficient of friction in the warp direction in polyester/nylon fabrics is always higher when compared to the equivalent UHMWPE/nylon structure. This observation is replicated in the weft direction as well. This is attributed to the inherently low coefficient of friction of UHMWPE fibres as compared with polyester fibres. The shape and length of heads and bases, as well as the texture of the yarns have definitely affected the SMD values of the fabrics. As an example, the SMD of plain polyester/nylon fabric in the warp direction is 5.94 but for the plain UHMWPE/nylon fabric the SMD in the same direction is 12.02. It seems the textured yarns are smoothed out more easily than flat filament yarns under the static load of the probe although their appearance is similar.

Colouring and Dying—Fabric Finishing

The fabric system of the present invention can be dyed and coloured in the same manner as fabrics of the prior art and the appearance is comparable. Hence fabrics of the present invention can be combined or integrated with fabrics of the prior art to give a consistent colour, look and feel.

The colouring methods described herein are applied to Nylon. This dying process can add weight to the finished fabric, typically by approximately 6%. Any weight gain through knitting and colourisation is commonly offset by stretch and heat setting. The weight gain (gsm increase) is normally caused by two factors, (i) the proportion of Spandex in the fabric (strength of Spandex, that is, whether high or low tension), and (ii) the amount of dye added during the colourisation process.

Scouring and dyeing processes were carried out in the same bath. UHMWPE has a low heat resistance and its melting temperature is around 150° C. The critical temperature for safe use of fibre is at or below 70° C. and the fibre tends to lose tensile strength at higher temperatures. The entire finishing process can be carried out at maximum of 60° C.

At the start of the dying process, a dye bath was filled with water at a material to liquor ratio of 1:20 and the temperature was raised to 40° C. A solution of 1% Albegal SET and 2 g/l Triton X100 was added with thorough stirring. Fabric manufactured according to the present invention was added to the solution and scoured for 15 minutes at a temperature at 40° C. with occasional stirring. The dye mixture was prepared by mixing 0.5% derma fur red RN 150%, 0.5% derma fur yellow RT and 0.5% derma fur blue BT 200% which are low molecular weight acid dyes supplied by Chemcolour Industries Australia Pty. Limited. The dye mixture was then added to the scouring bath left for 15 minutes. Subsequently, a 0.5% formic acid solution was added and the temperature was increased to 60° C. within 20 minutes. More 0.5% formic acid solution was added and left for another 25 minutes at 60° C. Then the dyed fabrics were rinsed in cold water and hydro-extracted. Fabrics were dried flat in the drying cabinet, and then conditioned for 24 hours under standard atmospheric conditions of 20±2° C. and 65±2% relative humidity When subjected to a series of tests, fabrics made of UHMWPE/nylon yarns performed equally as well as polyester/nylon fabrics in terms of surface roughness, friction and colour. In fact, the performance of cross-miss and birds-eye structures is better than the performance of the control fabrics in terms of surface roughness and friction.

Test Methods

The following standard test methods and modified test methods were used to evaluate the structural and physical properties and the performance of the fabrics:

- Australian Standard (AS) 2001.2.13-1987—Determination of mass per unit area and mass per unit length of fabrics
- AS 2001.2.6-2001—Determination of the number of wales and courses per unit length in knitted fabric
- AS 2001.2.15-1989—Determination of thickness of textile fabrics
- British Standard (BS) 4952 1992—Methods of test for elastic fabrics
  - 2.1—Determination of extension at a specified force
  - 2.4—Determination of residual extension Optical porosity Microscopic images were obtained with the light coming normally through the porous area of the fabric from below to calculate optical porosity. Motic trinocular zoom microscope together with the Motic image plus2.0 software was used. These images were processed using Imagetool software to calculate the percentages of black and white pixels of the images in which black pixels represented the area covered with yarns and white pixels represented the porous area.

$$\text{Optical porosity} = \frac{\text{white pixels}}{\text{black pixels} + \text{white pixels}} \times 100\%$$

Test for Impact Abrasion Resistance

A test method was developed in order to assess the impact abrasion resistance of the fabrics. The European standard EN13595-2:2002 is a test method that has been developed to determine the impact abrasion resistance of protective clothing including jackets, trousers and one piece or divided suits for professional motorcycle riders. This test method was referred and modified as suitable to test light weight, thin (thickness is approximately 1 mm or less) knitted fabrics.

This method was modified only slightly. The weight at impact we reduced to 2 kg as this enabled the current available industry garments to record a destruction time. To further help this a 60 grit belt was used.

The speed of the test machine was 28 km/h+ as per the European standard.

Test for Surface Friction and Roughness

KES-FB4 AUTO A Kawabata friction and roughness evaluation method is used to objectively measure the feel of a fabric, when the fabric is picked and stroked between fingers. This test method was used to assess surface properties of the technical back of the fabrics.

$$MIU = \frac{1}{X}\int \mu \cdot dx \quad \text{(Equation 2.1)}$$

$$MMD = \frac{1}{X}\int |\mu - \bar{\mu}| \cdot dx \quad \text{(Equation 2.2)}$$

$$SMD = \frac{1}{X}\int_{o}^{x} |T - \bar{T}| \cdot dx \quad \text{(Equation 2.3)}$$

Three main parameters MIU, MMD, SMD can be obtained directly using the software that has been integrated with the test equipment. MIU represents the mean coefficient of friction measured over 20 mm length forward and backward and MMD represents the mean deviation of μ from the average. SMD represents the mean deviation of the thickness measured in micrometers. Equations 2.1, 2.2 and 2.3 are the three mathematical fundamentals for MIU, MMD and SMD. The speed of both the roughness and friction probes was 1 mm/sec. The static load for the friction probe was 50 g and for the roughness probe was 10 g. 400 g force was the initial tension used on all the samples.

Test for Moisture Management Properties

Liquid moisture transfer properties of fabrics can be evaluated using moisture management tester (MMT). There are two concentric moisture sensors i.e. upper and lower sensor in the instrument. The test fabric should be placed on the lower sensor and upper sensor should be lowered carefully as both sensors touch the fabric. A constant amount of synthetic sweat is introduced onto the upper side of the fabric, which is the skin side. The spread of the solution will be in three ways.

1. Spread outward on the upper surface of the fabric
2. Transfer through the fabric to the bottom surface
3. Spread outward on the lower surface of the fabric These movements of moisture will be sensed and measured by the upper and lower moisture sensors.

Fabrics can be categorized in to seven different types based on the MMT results, in terms of liquid moisture transfer properties, and they are as follows:

1. Water proof fabric
2. Water repellent fabric
3. Slow absorbing and slow drying fabric
4. Fast absorbing and slow drying fabric
5. Fast absorbing and quick drying fabric
6. Water penetration fabric
7. Moisture management fabric [25]

Moisture management properties are considered only as a secondary requirement for this project. The objective of this study is to place the developed fabrics in the strategic places of garments for improved protection. So these fabrics do not necessarily have to have better moisture management properties. The test results were used to compare the properties of the commercial fabrics and the developed fabrics.

The fabric system of the present invention was equal to the currently available sporting garments available on the market today which is rating 5.

Comparison with Prior Art Garments

The fabric system of the present invention has been tested against the following three fabric systems of the prior art:

1. cycling knicks from Bio-Racer® with Dyneema pad inserted;
2. the fabric disclosed in U.S. Pat. No. 5,210,877; and
3. the thermo-regulating, cut resistant yarn and fabric described in US patent application 2011/0300366 and the cut resistant composite yarn described in US patent application 2012/0060563 A1.

1. Comparison with BioRacer®

The fabric system of the present invention was tested in a 'like for like' comparison with Bio-Racer® cycling knicks including a Dyneema pad which was stitched into the corners of the shorts for extra protection.

A comparison of the two fabric systems is provided in Table 3.

TABLE 3

| 'Like for like' comparison with Bio-Racer ® knicks | | |
|---|---|---|
| | Fabric System - present invention | Bio-Racer Fabric - Dyneema Knicks |
| Layer configuration | A single layer of fabric | Double layers of fabric (insertion of a pad) |
| Structure and yarn combination | Weft knit - Single jersey birds eye structure<br>Technical face - nylon (75 d)<br>Technical back - spandex (40 d) covered UHMWPE (100 d) | Inner fabric - weft knit double jersey (Interlock structure)<br>Technical face - spandex covered nylon<br>Technical back - micro fibre Dyneema (according to the advertisement)<br>Outer fabric - warp Knitted 80/20 nylon/lycra |
| Weight ($g/m^2$) | 365 | Inner - 325<br>Outer - 220<br>} Total - 545 |
| Thickness (mm) | 1.23 | 1.76 |
| Stretch (%) | Warp - 95<br>Weft - 97 | Warp - 58<br>Weft - 107 |
| Residual extension (%) | Warp - 22<br>Weft - 21 | Warp - 10<br>Weft - 29 |
| Abrasion time (s) | 3.36 (3.00 < 230-300 gsm)) | 3.87 |

In summary, the Bio-Racer fabric system is different to the fabric system of the present invention. The pad can not be dyed or coloured and also limits the movement/recovery and the wicking of the garment.

The fabric system of the present invention has greater stretch and residual extension overall. The abrasion time for the Bio-Racer fabric is higher but the fabric is also thicker; the fabric of the present invention offering a higher protection rate per unit GSM.

2. Comparison with the Fabric of U.S. Pat. No. 5,210,877

U.S. Pat. No. 5,210,877 describes outwear garments for cyclists comprising protective fabric panels comprising high performance yarn of ultra high molecular weight polyethylene fibre of approximately 215 denier, such as Spectra® in combination with Lycra® or other yarns such as those of wool, or acrylic, nylon, polyester, spandex or other natural or manmade fibre. The panels typically comprise separate, single layer, light weight, abrasion resistant, woven, knit or knit-woven protective fabric.

The fabric system of the present invention provides the benefits set out in Table 4 when compared to the fabric system disclosed in U.S. Pat. No. 5,210,877:

TABLE 4

| Comparison with U.S. Pat. No. 5,210,877 | | |
|---|---|---|
| | Fabric System - present invention | U.S. Pat. No. 5,210,877 |
| UV Stability | Does not include Spectra or Kevlar, and remains stable in direct contact with sunlight | Spectra break downs in the direct sunlight, |
| Weight | 360 GSM (Max), and can be reduced below 300 GSM | Not disclosed. Estimated 500+ GSM |
| Friction Resistance | Friction resistance (decay) time of 3.7 s at 360 GSM, and 3 s at >300 GSM. Can be reduced to approx. 250-280 denier without affecting results. | Not disclosed. Estimated 1 to 1.2 s |
| Structure | Lower GSM in a complete structure which allows integration with many other or similar UHWMPE fibres | The Spectra used is a minimum of 215 gsm, hence depending on knit structure will typically be at 400 GSM or greater. Too heavy for integration with most sports fabrics. |
| Breathability | Softer, cooler | Following from comments above - will increase wearer's core temperature, but reduces wicking and natural cooling. |
| Comfort & Feel | Less friction on the skin & subsequently more comfortable | |
| Colour | Able to be coloured and dyed, enabling integration into all types of garments. | Spectra is orange and cannot be dyed hence cannot be readily colour integrated or printed with sponsor logos/ advertising. Any fashion colouring or styling will be limited. |

TABLE 4-continued

| Comparison with U.S. Pat. No. 5,210,877 | | |
|---|---|---|
| | Fabric System - present invention | U.S. Pat. No. 5,210,877 |
| Elasticity | Greater elasticity. Greater stretch and return; good resistance in both weft and warp directions | |
| | | Testing results for the U.S. Pat. No. 5,210,877 patent under the same conditions are around 1 sec. The GRT Fabric system, which is significantly thinner, is 300 to 400% better. |

3. Comparison with the Fabric of US-2011/0300366 and US-2012/0060563

US patent applications 2011/0300366 and 2012/0060563 Staple fibres of coolmax and UHMWPE have been spun into a yarn, using ring spinning method to develop a thermo-regulating, cut resistant yarn. Table 5 below shows different percentages of fibres used to develop experimental yarns and fabrics. These yarns may also contain an elastomeric filament. Fabrics can be woven, knitted, non-woven and combinations. These fabrics claimed to be used for clothing items such as gloves, aprons, chaps, pants, shirts, jackets, coats, socks, undergarments, vests and hats and have improved thermo-regulating properties and cut resistant.

TABLE 5

| Comparative testing | | |
|---|---|---|
| Fabric types | UHMWPE % | Polyester (coolmax) % |
| Comparative 1 | 100 | 0 |
| Experiment 1 | 10 | 90 |
| Experiment 2 | 25 | 75 |
| Experiment 3 | 50 | 50 |
| Experiment 4 | 75 | 25 |
| Comparative 2 | 0 | 100 |

Further benefits of the fabric system of the present invention are set out in Table 6.

TABLE 6

| Fabric types | Yarn 1 | Yarn 2 | Yarn 3 | Machine type |
|---|---|---|---|---|
| Comparative Example 1 | 440dtex UHMWPE | 78dtex nylon (solution dyed) | 110dtex lycra | 13 gauge (needles per inch) knitting machine |
| Experiment 1 | 440dtex composite yarn 5% mineral fibre 95% UHMWPE | 78dtex nylon (solution dyed) | 110dtex lycra | 13 gauge knitting machine |
| Experiment 2 | 440dtex composite yarn 5% mineral fibre 95% UHMWPE | 156dtex nylon (solution dyed) | 110dtex lycra | 13 gauge knitting machine |
| Comparative Example 2 | 220dtex UHMWPE | 65dtex nylon (solution dyed) | 36dtex lycra | 18 gauge knitting machine |
| Experiment 3 | 220dtex composite yarn 5% mineral fibre 95% UHMWPE | 65dtex nylon (solution dyed) | 36dtex lycra | 18 gauge knitting machine |

Figure 7:
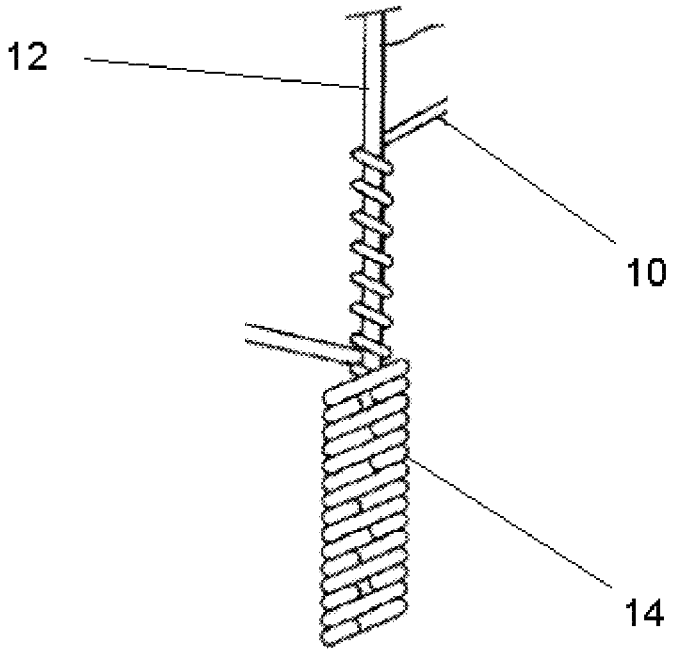
FIG. 7 is a diagram illustrating the method of manufacture of the composite yarn according to the present invention using a double covering method.

The composite yarns described in US-2011/0300366 and US-2012/0060563 have been manufactured using a double covering method as depicted in FIG. 7. In this manufacturing process the nylon yarn (10) is been wrapped around the elongated Lycra yarn (12) in S direction, then dyed nylon yarn (14) is been wrapped around in Z direction to cover the un-dyeable yarn (10). Several knitted fabrics has been prepared and tested using these composite yarns.

As per the test results set out in Table 7, cut resistance of fabrics that have been developed using 5% mineral fibres and 95% UHMWPE have strength increased by 3 to 3.5 times compared to fabric made with 100% UHMWPE.

TABLE 7

| Comparison with US patent applications 2011/0300366 and 2012/0060563 | | |
|---|---|---|
| | Fabric System - present invention | US patent applications 2011/0300366 & 2012/0060563 |
| Use | Mainly friction resistant | Mainly stab/cut resistant. Not typically used for sporting applications |
| Weight | Thinner, lighter weight, thus easier to integrate with other materials. Lower GSM | Bulkier, thicker, thus difficult to integrate with other materials. Higher GSM. |
| Breathability | | Thicker and heavier therefore wicking and cooling not as efficient. |
| Colouring | Can be extensively coloured | Can be coloured to some extent |

Many fabrics of the prior art have been developed for specific purposes, such as protecting soldiers, fire fighters or police during the course of their work. These fabrics have been designed to provide protection against projectiles such as bullets, sharp weapons such as knives, or impact such as a blow from a baton. Fabrics developed for these types of purposes are typically very thick and heavy. For example, Kevlar or Dyneema fabric used as inserts in trousers for motorcyclists weighs more than 600 g/m$^2$, and Kevlar bullet proof vests are very thick. Many of the fabrics of the prior art have a limited life span as they are sensitive to UV light and the colours of high performance fibre products are limited mostly to yellow, white and black, because they are unable to be dyed and cannot receive a printed a logo or other advertising indicia. Furthermore, the fabrics of the prior art have significant drawbacks in terms of moisture management, weight, wicking, heat transfer management, ability to be integrated into garments without detracting from the look and feel, and comfort for the everyday user.

The aforementioned prior art fabrics have significant benefits when used for their intended purpose, but cannot successfully be adapted for use in general apparel or garments for high activity such as playing sport. They are not typically suitable for those playing sport, athletes, children or the elderly.

The fabric system of the present invention was further tested and compared with the following commercially available fabrics used for sporting applications:

Commercial Fabric 1—fabric used in summer sports garments such as running shorts or pants, cycling shorts or pants;

Commercial Fabric 2—fabric used in a winter sports garment such as a long pair of running pants (thicker for warmth), or a longer pair of cycling pants or jersey; and Test Fabric 3 produced with regular knit and used for protection, similar to the fabric described in U.S. Pat. No. 5,210,877.

Figure 8A:
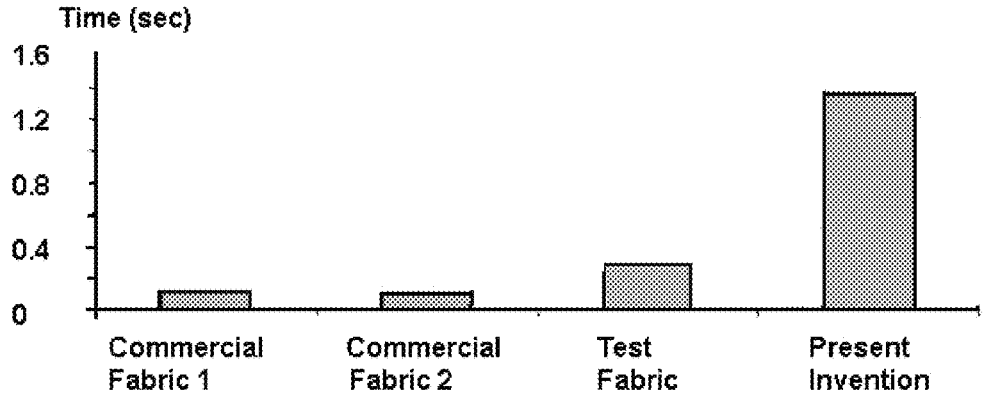
FIGS. 8(*a*), 8(*b*) and 8(*c*) illustrate test results comparing the fabric system of the present invention against three prior art fabric systems including plots of survival weft (cross-ways) indicating deterioration time (FIG. 8(*a*)), survival warp (length) and deterioration time (FIG. 8(*b*)) and fabric weight (FIG. 8(*c*)).
Figure 8B:
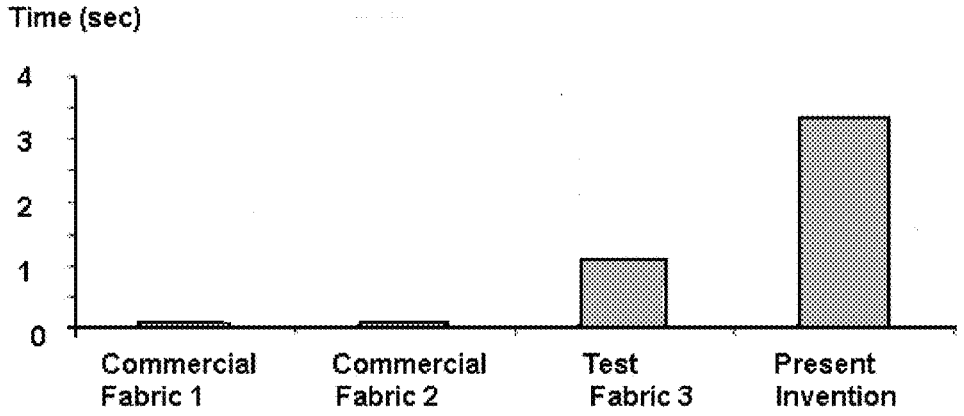
Figure 8C:
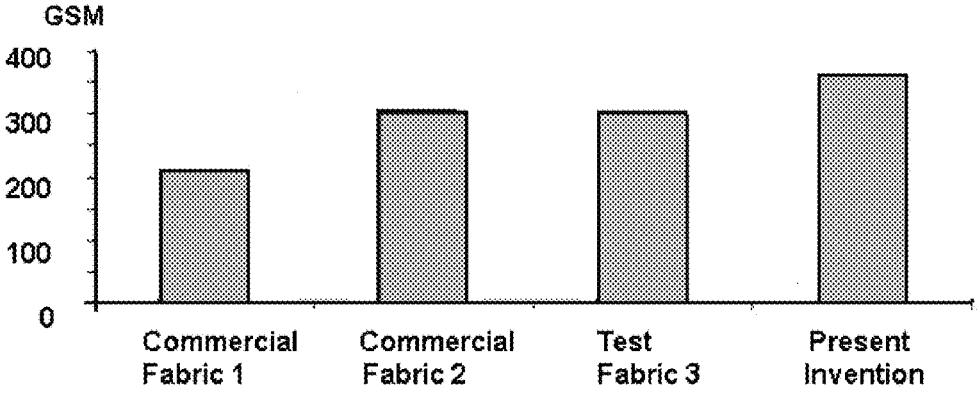
Figure 9A:
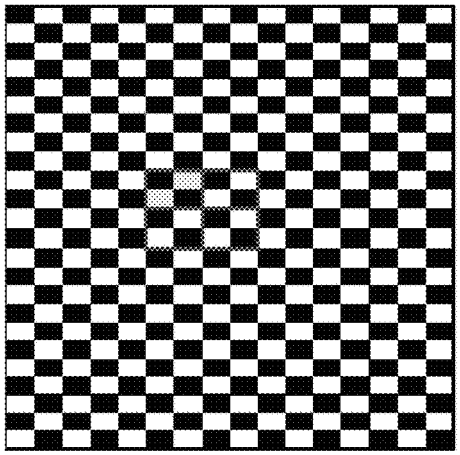
FIGS. 9(*a*), 9(*b*), 9(*c*), 9(*d*), 9(*e*) and 9(*f*) illustrate six different knitting structures, FIGS. 9(*a*) to 9(*f*) corresponding to structures T1 to T6, respectively.
Figure 9B:
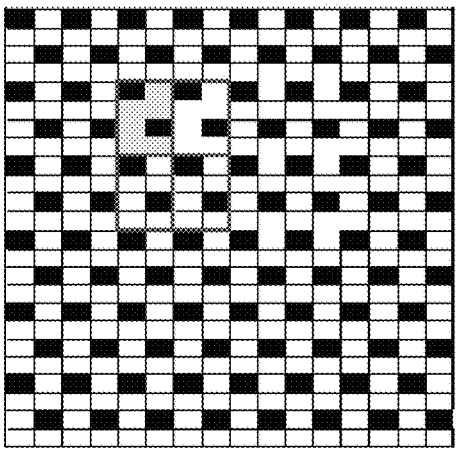
Figure 9C:
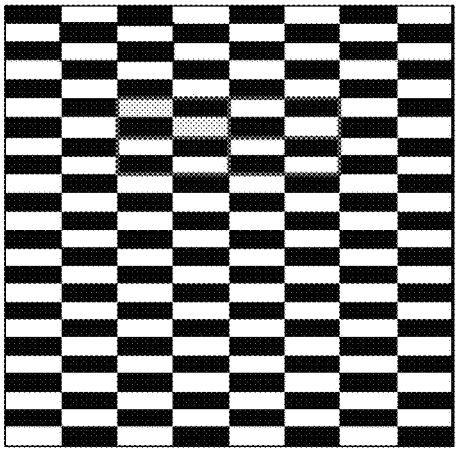
Figure 9D:
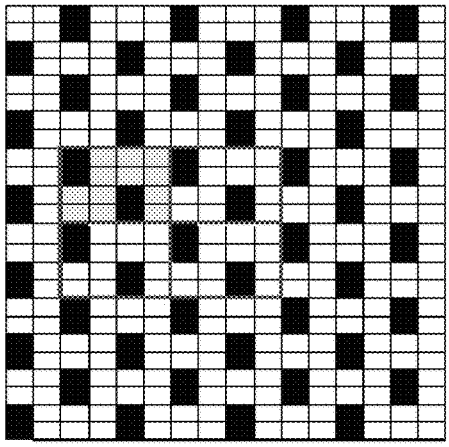
Figure 9E:
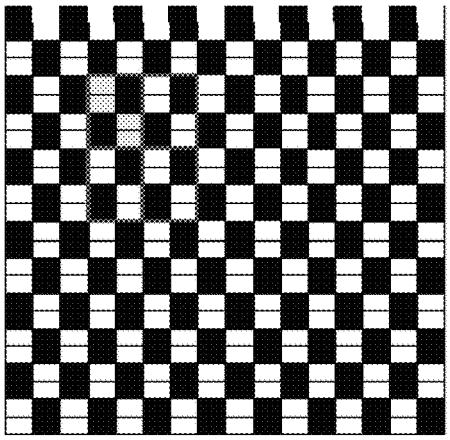
Figure 9F:
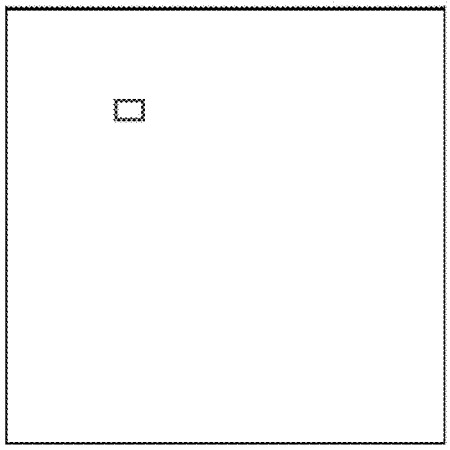

The testing results comparing weight and time to deterioration of both the weft and warp are set out in Table 8 and FIGS. 8(*a*) to 8(*c*).

TABLE 8

| Comparisons | |
|---|---|
| Yarns Used | Combination Details |
| A Commercial Fabric 1 | General Single Layer Fabric |
| B Commercial Fabric 2 | "Winter" Multiple Layer Fabric |
| C Nylon/UHMWPE | 140 denier Nylon & 100 denier UHMWPE |
| D Nylon/UHMWPE/Spandex | 75 denier Nylon, 100 denier UHMWPE & 40 denier Spandex |
| Survival Weft (cross ways) | Time to deteriorate: seconds |
| A Commercial Fabric 1 | 0.1 |
| B Commercial Fabric 2 | 0.1 |
| C Test Fabric 3 | 0.28 |
| D Fabric System - Present invention | 1.375 |
| Survival Warp (length) | Time to deteriorate: seconds |
| A Commercial Fabric 1 | 0.1 |
| B Commercial Fabric 2 | 0.1 |
| C Test Fabric 3 | 1.1 |
| D Fabric System - Present invention (minimum) | 3.35 up to >6 |
| Weight | GSM |
| A Commercial Fabric 1 | 210 |
| B Commercial Fabric 2 | 300 |
| C Test Fabric 3 | 300 |
| D Fabric System - Present invention | 230 to 360 |

As can be seen from Table 8, the fabric system of the present invention is significantly better by a factor of 3, when compared with the Test Fabric 3, and 30 to 40 times better than the two commercial fabrics tested.

The tested weight of fabric system of the present invention was slightly higher than Commercial Fabric 1 to higher than Test Fabric 3. The tests have revealed that the fabric system of the present invention can lower the GSM to below 300, which is lower than Test Fabric 3, or the winter weight sports garment, but is similar to summer weight thin garments or garments such as running tights. This still provides results 3 to 4 times better then the Test Fabric 3 and 30 to 40 times better than the two Commercial Fabrics when comparing like to like.

Additional Yarn Combinations

In addition to the fibres and fabrics described above the following additional combinations were tested:

A1—50 Denier UHWMPE with DC low power Spandex® & Nylon 75 Denier

A2—50 Denier UHWMPE with DC high power Spandex® & Nylon 75 Denier

A3—50 Denier UHWMPE with SC low power Spandex® & Nylon 75 Denier

A4—50 Dener UHWMPE with SC high power Spandex® & Nylon 75 Denier

A5—50 Denier UHWMPE with DC low power Spandex® & Nylon Super Micro Fibre

A6—50 Denier UHWMPE with DC high power Spandex® & Nylon Super Micro Fibre

A7—50 Denier UHWMPE with SC low power Spandex® & Nylon Super Micro Fibre

A8—50 Denier UHWMPE with SC high power Spandex® & Nylon Super Micro Fibre

A9—30 Denier UHWMPE with DC low power spandex & Nylon Super Micro Fibre

A10—30 Denier UHWMPE with DC high power Spandex® & Nylon Super Micro Fibre

A11—30 Denier UHWMPE with TC low power Spandex®x & Nylon Super Micro Fibre

A12—30 Denier UHWMPE with TC high power Spandex® & Nylon Super Micro Fibre

The abbreviation 'DC' refers to UHWMPE and Nylon Super Micro Fibre, and 'TC' refers to UHWMPE and 2× Nylon Super Micro Fibre All 12 new additional combinations provided results 30× greater than current commercially available yarns, subject to application. Table 9 sets out testing results for the fabrics, based on T5 structure:

TABLE 9

| Fabrics | Weight GSM | Structure | Time to Deteroriate |
|---|---|---|---|
| A1 to A4 | 269 GSM | T5 | 6.0 + seconds |
| A5 to A8 | 244 GSM | T5 | 6.0 + seconds |
| A9 to A12 | 220 GSM | T5 | 3.5 + seconds |

Fabrics A1 to A4 were thicker and heavier than the other fabrics and provided the highest level of resistance independent of knitting structure. Fabrics A5 to A8 were not as thick, with the SC being slightly lighter weight, however better hand feel was achieved with the DC fabrics. Fabrics A9 to A12 were lighter than the other fabric, and exhibited lower resistance, but the resistance was still 30 times greater than commercially available equivalents and the hand feel was significantly better.

Further testing was also conducted on the knitting structures, using structures T1 to T6 illustrated in FIGS. 9(*a*) to 9(*f*), which were all formed of eight feeds and correspond to the following unit cell sizes:

T1—2×2
T2—2×4
T3—4×2
T4—4×4
T5—2×4
T6—single jersey, 1×1

The structures T5, T1, T3 and T2 produced the most optimal results across all the samples tested. Specifically, they exhibited the lightest weight, highest resistance, best hand feel, greatest utility and were the most wearable fabrics.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive.

Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of 'including, but not limited to'.

The claims defining the invention are as follows:

1. A composite yarn comprising:
one or more polyurethane-polyurea copolymer fibres; and
one or more ultra-high molecular weight polyethylene fibres,
wherein the one or more ultra-high molecular weight polyethylene fibres are wrapped around the one or more polyurethane-polyurea copolymer fibres, and
wherein the one or more polyurethane-polyurea copolymer fibres are between 20 and 40 denier.

2. The composite yarn according to claim 1 wherein the one or more ultra-high molecular weight polyethylene fibre is between 10 and 250 denier.

3. A fabric system comprising:
ultra-high molecular weight polyethylene yarn,
polyurethane-polyurea copolymer yarn, and
a further natural or synthetic yarn,
wherein the polyurethane-polyurea copolymer yarn is between 20 and 40 denier.

4. The fabric system according to claim 3 wherein the ultra-high molecular weight polyethylene fibre is between 10 and 250 denier.

5. The fabric system according to claim 3 wherein the further natural or synthetic yarn is a polyamide chosen from the group nylon 6, nylon 6:6, nylon 5:10 or nylon 6:12.

6. The fabric system according to claim 3 wherein the further natural or synthetic yarn is between 10 and 150 denier.

7. The fabric system according to claim 3 comprising a composite yarn comprising:
one or more polyurethane-polyurea copolymer fibres; and
one or more ultra-high molecular weight polyethylene fibres,
wherein the one or more ultra-high molecular weight polyethylene fibres are wrapped around the one or more polyurethane-polyurea copolymer fibres, and
wherein the one or more polyurethane-polyurea copolymer fibres are between 20 and 40 denier.

8. A method of manufacturing the composite yarn of claim 1 comprising the step of wrapping an ultra-high molecular weight polyethylene yarn around a polyurethane-polyurea copolymer yarn.

9. The method of manufacturing the composite yarn according to claim 8 wherein the ultra-high molecular weight polyethylene yarns are wrapped around the polyurethane-polyurea copolymer yarn at a rate of between 200 and 800 turns per meter.

10. The method of manufacturing the composite yarn according to claim 8 wherein the ultra-high molecular weight polyethylene yarns are S twisted yarns.

11. The method of manufacturing the composite yarn according to claim 8 wherein the ultra-high molecular weight polyethylene yarns are Z twisted yarns.

12. The method of manufacturing the composite yarn according to claim 8 wherein at least some of the ultra-high molecular weight polyethylene yarns are S twisted yarns and at least some of the some of the ultra-high molecular weight polyethylene yarns are Z twisted.

13. The method of manufacturing the composite yarn according to claim 8 wherein the wrapping is by air intermingling, single covering, double covering or combinations thereof.

14. A method of manufacturing fabric system having a first yarn of nylon and a second yarn comprising a composite of ultra-high molecular weight polyethylene and polyurethane-polyurea copolymer, the method comprising the step of knitting the first yarn with the second yarn to create a structure chosen from the group comprising single jersey plain knit, weft-locknit, cross-miss and birds-eye knit.

15. A garment comprising the composite yarn of claim 1.

16. A garment comprising a fabric system including ultra-high molecular weight polyethylene yarn between 20 and 40 denier, polyurethane-polyurea copolymer yarn and a further natural or synthetic yarn.

17. A garment having at least two panels wherein at least one of the panels comprises a fabric system including ultra-high molecular weight polyethylene yarn, polyurethane-polyurea copolymer yarn between 20 and 40 denier and a further natural or synthetic yarn.

18. The composite yarn according to claim 1 wherein the one or more ultra-high molecular weight polyethylene fibre is between 75 and 125 denier.

19. The fabric system according to claim 3 wherein the ultra-high molecular weight polyethylene fibre is between 75 and 125 denier.

20. The fabric system according to claim 3 wherein the further yarn is between 20 and 75 denier.

* * * * *